US011820467B2

(12) United States Patent
Gao et al.

(10) Patent No.: US 11,820,467 B2
(45) Date of Patent: Nov. 21, 2023

(54) SINGLE-UPRIGHT-COLUMN MOORING TYPE WELLHEAD PRODUCTION OPERATION PLATFORM

(71) Applicant: SHANDONG DINGSHENG ELECTROMECHANICAL EQUIPMENT INC., Dongying (CN)

(72) Inventors: Xinshui Gao, Dongying (CN); Yong Yue, Dongying (CN); Naisheng Ge, Dongying (CN)

(73) Assignee: SHANDONG DINGSHENG ELECTROMECHANICAL EQUIPMENT INC., Dongying (CN)

( * ) Notice: Subject to any disclaimer, the term of this patent is extended or adjusted under 35 U.S.C. 154(b) by 0 days.

(21) Appl. No.: 17/626,476

(22) PCT Filed: Aug. 5, 2020

(86) PCT No.: PCT/CN2020/107082
§ 371 (c)(1),
(2) Date: Jan. 11, 2022

(87) PCT Pub. No.: WO2021/036722
PCT Pub. Date: Mar. 4, 2021

(65) Prior Publication Data

US 2022/0281561 A1 Sep. 8, 2022

(30) Foreign Application Priority Data

Aug. 23, 2019 (CN) ..... 201910785784.6
Aug. 23, 2019 (CN) ..... 201910786544.8
Aug. 23, 2019 (CN) ..... 201910786553.7

(51) Int. Cl.
*E21B 43/01* (2006.01)
*B63B 21/50* (2006.01)

(52) U.S. Cl.
CPC ..... *B63B 21/507* (2013.01); *E21B 43/0107* (2013.01); *B63B 2021/505* (2013.01)

(58) Field of Classification Search
CPC ..... E21B 19/004; E21B 43/0107; B63B 2021/505; B63B 21/507
See application file for complete search history.

(56) References Cited

U.S. PATENT DOCUMENTS 4,602,586 A * 7/1986 Ortloff ..... B63B 22/021 114/230.14
4,665,856 A 5/1987 Pedersen
(Continued)

FOREIGN PATENT DOCUMENTS

CN 2878506 Y 3/2007
CN 202783719 U 3/2013
(Continued)

OTHER PUBLICATIONS

Jing Yong, et al.: "Integration Solutions of Wellhead Platform and a Single Point Mooring"; (CNOOC Energy Technology and Services Ltd, OPSC, Tianjin300452, China); pp. 5.
(Continued)

*Primary Examiner* — Matthew R Buck
(74) *Attorney, Agent, or Firm* — CANTOR COLBURN LLP

(57) ABSTRACT

Disclosed is a single-upright-column mooring type wellhead production operation platform, comprising an upright column body, a positioning and mounting assembly, a rotating table, an oil extraction operation platform and at least one inner well slot, wherein the upright column is of a hollow structure; the positioning and mounting assembly is arranged at a bottom of the upright column body; the rotating table is arranged outside the upright column body, is rotatable around an axis of the upright column body and comprises a mooring connection apparatus; the oil extrac-
(Continued)

tion operation platform is arranged on the top of the upright column body and is located above the rotating table, and the oil extraction operation platform is provided with an oil extraction operation assembly; and the inner well slot is arranged in the upright column body and can be connected to the oil extraction operation platform. The platform can adapt to an economic index of extraction of a marginal field. Disclosed are a single-upright-column wellhead production operation platform and a rotary mooring conveying system for oil-producing operation at the same time.

14 Claims, 7 Drawing Sheets

(56) References Cited

U.S. PATENT DOCUMENTS 5,288,253 A * 2/1994 Urdshals ..... B63B 22/023 114/230.26
6,053,787 A * 4/2000 Erstad ..... B63B 22/026 405/224.2
6,178,910 B1 * 1/2001 Pollack ..... B63B 22/026 114/230.12
6,193,574 B1 * 2/2001 Pollack ..... B63B 22/026 405/224.2
6,227,135 B1 * 5/2001 Pedersen ..... E02B 3/24 114/230.15
7,690,434 B2 * 4/2010 Baross ..... B63B 21/508 441/5
8,960,299 B2 * 2/2015 Espinasse ..... E21B 43/0107 166/365
11,279,446 B2 * 3/2022 Yu ..... B63B 21/50
2010/0326667 A1 * 12/2010 Coppens ..... B63B 21/507 114/230.1
2014/0283727 A1 9/2014 Liu et al.

FOREIGN PATENT DOCUMENTS

| | | | | |
|---|---|---|---|---|
| CN | 103032046 | A | | 4/2013 |
| CN | 203186554 | U | | 9/2013 |
| CN | 203186654 | U | | 9/2013 |
| CN | 204254099 | U | | 4/2015 |
| CN | 205530194 | U | | 8/2016 |
| CN | 106025747 | A | | 10/2016 |
| CN | 106043602 | A | * | 10/2016 |
| CN | 207450170 | U | | 6/2018 |
| CN | 208053568 | U | | 11/2018 |
| CN | 109309331 | A | | 2/2019 |
| CN | 110422294 | A | | 11/2019 |
| CN | 110422295 | A | | 11/2019 |
| CN | 110435820 | A | | 11/2019 |
| JP | 2016111925 | A | | 6/2016 |
| WO | 2002092423 | A1 | | 11/2002 |

OTHER PUBLICATIONS

International Search Report Application No. PCT/CN2020/107082; dated Oct. 28, 2020; pp. 4.
Notice of Refusal issued in Japanese Patent Application No. 2022-508469; Application Filing Date Aug. 5, 2020; dated Mar. 5, 2023 (8 pages).

* cited by examiner

SINGLE-UPRIGHT-COLUMN MOORING TYPE WELLHEAD PRODUCTION OPERATION PLATFORM

CROSS REFERENCE TO THE RELATED APPLICATIONS

This application is the national phase entry of International Application No. PCT/CN2020/107082, filed on Aug. 5, 2020, which is based upon and claims priority to Chinese Patent Application No. 201910786553.7, 201910786544.8 and 201910785784.6 filed on Aug. 23, 2019, the entire contents of which are incorporated herein by reference.

TECHNICAL FIELD

The present disclosure relates to the field of ocean oil and gas development and relates to a single-upright-column mooring type wellhead production operation platform.

DESCRIPTION OF RELATED ART

In shallow sea areas of China, many marginal fields have been explored. The marginal fields refer to oilfields, the explored outputs of which are relatively small (the exploitable reserve of a single oilfield ranges from about 100 thousand tons to 2000 thousand tons), the geographic positions of which are scattered and the distances of which to other large oilfields are relatively great, and the development economic benefit of which is relatively poor in a conventional development mode.

An intact oilfield development process includes four processes: drilling (repairing)-recovering-storing-transporting. Development modes of existing conventional shallow oilfields in China mainly include the following portions: (1) one or more wellhead platforms; (2) Floating Production Storage and Offloading (FPSO); (3) a jacket rack and a single-point system mooring the FPSO; and (4) submarine pipelines that connect the wellhead platforms with the FPSO.

The wellhead platform is usually a platform in form of the jacket rack. The wellhead platform carries a Christmas tree. The FPSO is moored to one jacket rack by a single-point mooring system. The wellhead platform conveys a crude oil mixture to the FPSO via the submarine pipeline to be produced and stored, and meanwhile, the FPSO supplies electricity and liquids needed by living and operation to the wellhead platform via a cable. A shuttle tanker arrives at the FPSO periodically to transport crude oil to a land.

Compared with the wellhead platform, the currently used mooring platform for mooring the PFSO is a completely different jacket rack, and the wellhead platform and the mooring platform are not universal. The FPSO is moored to the mooring platform and is then connected with the wellhead platform via the submarine pipeline. In order to reserve a safe distance, it is needed to bury the costly submarine pipeline. With respect to dense oilfields with large outputs, costs of the mooring platform, the wellhead platform and the correspondingly arranged submarine pipelines can be equally shared by a plurality of oilfields with very high stability, so that ideal economical benefits can be gained. With respect to marginal fields, it is improper because the unit output of the marginal field is lower than that of dense high-output oilfields. With respect to a single marginal oilfield, the equipment investment may be higher than gained earnings or merely very low earnings are gained. Restricted thereby, development of some marginal fields is put aside temporarily.

In view of economical requirements, two operating modes are adopted to develop the marginal fields:

(1) a "three-one" development mode, that is, with respect to a marginal oil and gas field which is within 20 km far away from a developed oilfield, the produced oil and gas field is sent to the developed oilfield by means of a wellhead platform, a submarine pipeline and a submarine cable.

(2) a "bee" type development mode, that is, with respect to small isolated marginal oil and gas fields which are more than 20 km far away from the developed oilfield and cannot depend on the developed oilfield, a movable small production apparatus which integrates well drilling (repairing), production, power, oil storage, external transportation and living as a whole to develop the marginal field.

At present, most marginal fields are more than 20 km far away from the developed oilfield, and it still costs high for the submarine pipeline which is within 20 km long. Therefore, the "bee" development mode is the main scheme for many marginal fields.

The development mode primarily provides a movable platform structure, so that operation functions such as production, power, oil storage, external transportation and living can be integrated to a small production apparatus. The platform structure, like a bee, can be moved to another small oilfield to extract oil after extracting oil from a small oilfield. By adopting the "bee" development mode, the marginal fields have certain economical benefits. However, in order to realize mobility of the platform, the shape of the platform may be limited to a certain extent. It is hard to configure an enough space to store oil. In general, the full load reserve may not exceed 2000 tons and the shuttle tanker extracts oil too frequently, so that the economical benefit of the whole oilfield development is lowered.

Another train of thought is to connect a storage and transportation ship and a jacket integrally in a normal production state. The jacket is used for production and the storage and transportation ship is used for storing crude oil, so that it has the functions of production, power, oil storage, external transportation and living. However, as a result of the thought, the load of the storage and transportation ship is far larger than that of an oil storage apparatus configured to an original platform in the production state, which leads to poor ability of a system to resist storms. In particular, when the storage and transportation ship is in a beam sea state, the transverse load is extremely large, and severe rolling motion is easy to cause destroy of associated equipment and lines so as to cause accidents.

Therefore, the existing wellhead platform structure is changed to meet the economical requirements of development of marginal fields.

It is to be noted that the above content is a part of technical cognitive category of the inventor and does not necessarily constitute the prior art.

SUMMARY OF THE INVENTION

Aiming at deficiencies in the background art, the present disclosure aims to provide a production operation platform capable of improving an economical index of development of a marginal field. The platform can improve compactness of arrangement of oil extraction operation devices, decrease the quantity of facilities and lower the input cost, has good stability and safety, further integrates the functions of well repairing, production, power, oil storage, external transportation, living and the like, and supports expansion of a large enough oil storage space.

The technical scheme adopted by the present disclosure is as follows:

A single-upright-column mooring type wellhead production operation platform includes:

an upright column body of a hollow structure;

a positioning and mounting assembly arranged at a bottom of the upright column body;

a rotating table arranged outside the upright column body and rotatable around an axis of the upright column body, the rotating table comprising a mooring connection apparatus;

an oil extraction operation platform arranged on the top of the upright column body and located above the rotating table, the oil extraction operation platform being provided with an oil extraction operation assembly; and at least one inner well slot arranged in the upright column body, the inner well slots being capable of being connected to the oil extraction operation platform.

According to the technical scheme, around the hollow upright column body: a positioning and mounting assembly arranged at a bottom of the upright column body, the upright column body is steadily placed in a sea area of an oilfield. The rotating table outside the upright column body supports the platform to realize the mooring function, for example, mooring the FPSO. After being moored to the rotating table, the FPSO can rotate together with the rotating table around the upright column body when encountering storms. A plurality of, for example 3-6, inner well slots can be formed in the upright column body to support oil extraction operation. The oil extraction operation assembly is arranged on the oil extraction operation platform on the top of the rotating table. By arranging the upright column body structure reasonably, mooring and oil extraction operations do not affect each other and can be carried out simultaneously. The mooring operation and the oil extraction operation are integrated to the production operation platform based on the same upright column body, i.e., the wellhead platform and the single-point mooring jacket in the conventional shallow oilfield development mode are integrated, so that the submarine pipeline arranged between the mooring platform and the wellhead platform is canceled and the quantity of the arranged platform jackets is further decreased. The development cost of the marginal fields can be lowered greatly, so that it has very good promotional value.

In a preferred implementation mode, the positioning and mounting assembly includes several pile foundations and a conduit that connects the pile foundations with the upright column body.

In a preferred implementation mode, the positioning and mounting assembly includes a pile foundation column body that extends downwards along a bottom of the upright column body.

Optionally, the upright column body and the pile foundation column body are formed integrally, i.e., one end of the bottom of the upright column body is taken as a single pile foundation, and the upright column body is tamped into a seabed for fixation. Form of the positioning and mounting assembly can be selected according to different sea conditions, and various positioning modes can be matched simultaneously as well.

In a preferred implementation mode, the rotating table includes a rotating table main body and a rotating table bearing, an inner ring of the rotating table bearing being fixedly connected with the upright column body.

The bearing used by the rotating table is preferably a rolling bearing, and at the moment, the outer ring of the bearing of the rotating table is fixedly connected with the rotating table main body. Under some conditions, a sliding bearing can be also used. At the moment, a lubricating layer of the bearing is to be between an outer surface of the bearing and an inner surface of a bearing position formed by the rotating table main body, and the inner surface of the bearing is to be fixed with the upright column body in a close-fitting manner.

In a preferred implementation mode, the platform further includes a rotary conveying assembly connected with the rotating table, the rotary conveying assembly including:

several rotary conveying joints, each of the rotary conveying joints comprising:

an inner conveying ring fixedly connected with the upright column body;

an outer conveying ring following the rotating table to rotate relative to the inner conveying ring, where a conveying structure capable of keeping conveying in a rotating process is arranged between the inner conveying ring and the outer conveying ring;

an inner conveying unit connected with the conveying structure and the oil extraction operation assembly; and an outer conveying unit connected with the conveying structure.

A further preferred mode is to fix the conveying unit via the mooring apparatus.

By arranging the rotary conveying joints, provided is a solving way which preferably eliminates conflict between oil extraction operation and mooring operation on the production operation platform. The floating production oil storing and unloading apparatus moored at the rotating table drives the rotating table to rotate by storms, and at the moment, outer conveying units, for example, a water delivery pipeline, an oil pipeline, a power supply line and the like, are connected to the floating production oil storing and unloading apparatus. In order to avoid winding and stretching, it is necessary to rotate the conveying joints. In the rotating process of the rotating table, inner and outer conveying states are kept stable.

In a preferred implementation mode, the conveying structure is used for conveying a fluid or electric energy.

In a preferred implementation mode, the oil extraction operation platform includes a wellhead deck, and the oil extraction operation assembly includes at least one of an oil extraction tree, a manifold terminal and a production auxiliary system.

The production auxiliary system is conventional oilfield development operation equipment which includes, but not limited to, a power supply facility, a control instrument facility, a hoisting facility, a fire-fighting facility, a safety facility and a monitoring facility.

In a preferred implementation mode, the oil extraction operation platform further includes a well repair deck arranged above the wellhead deck and is used to bear a well repair device.

Well repairing equipment preferably repairs the well hydraulically, can be further matched with a conventional workover rig to carry related well repair facilities, and mainly provides a function that a drilling (well repairing) vertical tube penetrates into the inner well slot.

In a preferred implementation mode, the inner well slot includes a riser connected with the oil extraction operation platform or the oil extraction operation assembly; and the upright column body is internally provided with a positioning and isolating structure that supports the riser.

In a preferred implementation mode, the mooring connection apparatus includes a rotating joint and a disconnecting apparatus arranged on the rotating joint, the disconnecting apparatus being configured to remove a connection between the rotating joint and the rotating table or the disconnecting apparatus being configured to remove a connection between the disconnecting apparatus and the rotating joint.

An oilfield production operation system, the system including:

the abovementioned single-upright-column mooring type wellhead production operation platform;

a floating production oil storing and unloading apparatus; and a mooring apparatus that connects the floating production oil storing and unloading apparatus with the mooring connection apparatus.

The single-upright-column mooring type wellhead production operation platform is applied to being matched with the floating production oil storing and unloading apparatus to realize oil-producing and oil-storing operations jointly. The system has the advantages of large oil storage capacity, high resistance to storms and the like. Under a circumstance that the integral facility is simplified greatly and the input cost is lowered greatly, the function is not deducted, and the system still has all the functions of well repair, production, power, oil storage, external transportation and living, so that many isolated marginal fields are developed to have economical benefits.

A single-upright-column type wellhead production operation platform includes:

an upright column body of a hollow structure;

a positioning and mounting assembly arranged at a bottom of the upright column body;

an oil extraction operation platform arranged on the top of the upright column body, the oil extraction operation platform being provided with an oil extraction operation assembly; and at least one inner well slot arranged in the upright column body, the inner well slots being capable of being connected to the oil extraction operation platform.

According to the technical scheme, around the hollow upright column body: a positioning and mounting assembly arranged at a bottom of the upright column body, the upright column body is steadily placed in a sea area of an oilfield. A plurality of, for example 3-6, inner well slots can be formed in the upright column body to support oil extraction operation. The oil extraction operation assembly is arranged on the oil extraction operation platform on the top of the rotating table. By arranging the upright column body structure reasonably, all functions needed by oil extraction operation are integrated to the production operation platform based on the same upright column body, i.e., it is unnecessary to configure the FPSO for a seabed transmission mode, so that the single-point mooring jacket and the submarine pipeline arranged between the mooring platform and the wellhead platform are canceled, so that the development cost of the marginal fields can be lowered greatly, and therefore, it has very good promotional value.

As a preferred implementation mode, the positioning and mounting assembly includes several pile foundations and a conduit that connects the pile foundations with the upright column body.

As a preferred implementation mode, the positioning and mounting assembly includes a pile foundation column body that extends downwards along a bottom of the upright column body.

Optionally, the upright column body and the pile foundation column body are formed integrally, i.e., one end of the bottom of the upright column body is taken as a single pile foundation, and the upright column body is tamped into a seabed for fixation. Form of the positioning and mounting assembly can be selected according to different sea conditions, and various positioning modes can be matched simultaneously as well.

As a preferred implementation mode, a radial dimension of a hollow portion of the upright column body ranges from 2 m to 6 m.

As a preferred implementation mode, the inner well slot includes a riser connected with the oil extraction operation platform or the oil extraction operation assembly; and the upright column body is internally provided with a positioning and isolating structure that supports the riser.

As a preferred implementation mode, there are a plurality of risers;

the positioning and isolating structure includes:

a plurality of positioning rings sleeved outside the risers, the positioning rings being connected successively via a connecting rib; and a radial support connected with the positioning rings and/or the connecting rib, the radial support leaning against or being connected with an inner wall of the hollow portion of the upright column body.

The plurality of inner well slots are formed in the upright column body by positioning and isolating, and by the positioning and isolating structure, multi-drilling stable production can be supported.

As a preferred implementation mode, the risers are circumferentially and evenly distributed around an axis of the upright column body.

As a preferred implementation mode, the oil extraction operation platform includes a wellhead deck, and the oil extraction operation assembly includes at least one of an oil extraction tree, a manifold terminal and a production auxiliary system.

The production auxiliary system is conventional oilfield development operation equipment which includes, but not limited to, a power supply facility, a control instrument facility, a hoisting facility, a fire-fighting facility, a safety facility and a monitoring facility.

As a preferred implementation mode, the oil extraction operation platform further includes a well repair deck arranged above the wellhead deck and is used to bear a well repair device.

Well repairing equipment preferably repairs the well hydraulically, can be further matched with a conventional workover rig to carry related well repair facilities, and mainly provides a function that a drilling (well repairing) vertical tube penetrates into the inner well slot.

As a preferred implementation mode, the oil extraction operation platform further includes a manifold deck and/or a water injection deck and/or an embarkation deck.

The single-upright-column type wellhead production operation platform is applied to being matched with shared part of energy facilities near the developed oilfield to realize oil-producing and oil-storing operations jointly, thereby forming an oilfield network. As it is unnecessary to moor the FPSO, the system is high in resistance to storms. The integral facility is simplified greatly and the input cost is lowered greatly. Dependent on the developed oilfield, the system has all the functions of well repair, production, power, oil storage, external transportation and living simultaneously, so that many marginal fields close to the developed oilfield are developed to have economical benefits.

In addition, it aims to improve the structure of the production operation platform so as to improve the economical index of development of the marginal fields, improve compactness of arrangement of oil extraction operation devices, decrease the quantity of facilities and lower the input cost, has good stability and safety, further integrates the functions of well repairing, production, power, oil storage, external transportation, living and the like, and supports expansion of a large enough oil storage space. The key point lies in that the rotary mooring conveying system applied to the wellhead platform is provided so as to convey fluids and energy sources between the FPSO moored to the wellhead platform and the oil extraction operation apparatus.

The present disclosure further provides a rotary mooring conveying system, the system including several rotary conveying joints, each of the rotary conveying joints including:

an inner conveying ring;

an outer conveying ring capable of rotating relative to the inner conveying ring, where a conveying structure capable of keeping conveying in a rotating process is arranged between the inner conveying ring and the outer conveying ring;

an inner conveying unit, the inner conveying unit being connected with the inner conveying ring; and an outer conveying unit, the outer conveying unit being connected with the outer conveying ring, where the inner conveying rings of the rotary conveying joints are fixedly connected.

In the development and extraction operation of the marginal fields, one concept is that the wellhead platform and the single-point mooring jacket are integrated, where the problem to be solved is that the FPSO moored to the rotating table arranged on the wellhead platform will swing and rotate along with storms, it is unnecessary to keep non-interruption of conveyance between the oil extraction operation apparatus arranged in the wellhead platform and the FPSO in the mooring process, and conveyance is not affected. Furthermore, interference to normal operation of the operation platform is further avoided.

By arranging the rotary conveying joints, provided is a solving way which preferably eliminates conflict between oil extraction operation and mooring operation on the production operation platform. The floating production oil storing and unloading apparatus moored at the rotating table drives the rotating table to rotate by storms, and at the moment, outer conveying units, for example, a water delivery pipeline, an oil pipeline, a power supply line and the like, are connected to the floating production oil storing and unloading apparatus. In order to avoid winding and stretching, it is necessary to rotate the conveying joints. In the rotating process of the rotating table, inner and outer conveying states are kept stable.

As a preferred implementation mode, the several rotary conveying joints are successively arranged from top to bottom, and inner conveying units connected with the inner conveying rings of the rotary conveying joints located below penetrate through inner channels formed in the inner conveying rings of the rotary conveying joints above.

As a preferred implementation mode, at least one rotary conveying joint is a fluid conveying joint.

As a preferred implementation mode, the conveying structure is an annular fluid groove formed between the inner conveying ring and the outer conveying ring, the inner conveying unit includes a fluid pipeline, and the fluid pipeline is communicated with the annular fluid groove.

As a preferred implementation mode, a fluid conveyed by the fluid conveying joint is selected from one or more of water, oil and gas.

As a preferred implementation mode, a dynamic seal ring is arranged between the inner conveying ring and the outer conveying ring to form a sealing structure that isolates the annular fluid groove and outside.

As a preferred implementation mode, at least one rotary conveying joint is a data transmission joint, the transmission structure is an electric brush arranged between the inner conveying ring and the outer conveying ring, and the inner conveying unit includes a data line electrically connected with the electric brush. It can be further used for transmitting data, and a data line is used as the conveying unit.

As a preferred implementation mode, a dynamic seal ring is arranged between the inner conveying ring and the outer conveying ring to form a sealing structure that isolates the annular fluid groove and outside.

As a preferred implementation mode, a bearing is arranged between the inner conveying ring and the outer conveying ring.

As a preferred implementation mode, the platform further includes a rotating table, the rotating table being connected with each outer conveying ring.

BRIEF DESCRIPTION OF DRAWINGS

The drawings described herein for further understanding of the present disclosure consists a part of the present disclosure. The schematic embodiment and description thereof are used for explaining the present disclosure and do not limit the present disclosure improperly. In the drawings.

DESCRIPTION OF NUMERALS IN DRAWINGS

Figure 1:
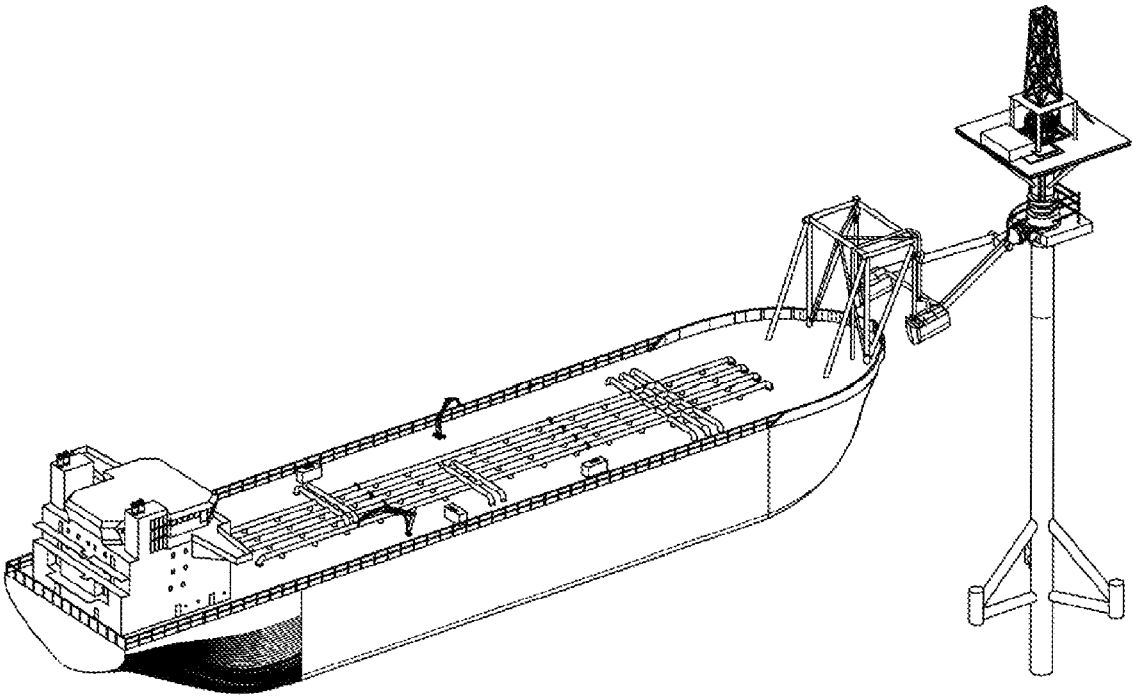
FIG. 1 illustrates an integral structural schematic diagram of an oilfield production operation system in an embodiment of the present disclosure.

1, Floating Production Storage and Offloading (FPSO); 2, upright column body; 3, positioning and mounting assembly; 4, rotating table; 5, wellhead deck; 6, Christmas tree; 7, manifold terminal; 8, well repairing deck; 9, hydraulic workover rig; 10, rotary conveying assembly; 11, bearing of rotating table; 12, mooring supporting rack; 13, horizontal balance weight rigid arm; 14, balance weight cabin; 15, mooring lazy arm; 16, rigid conveying pipeline; 17, flexible crossover pipeline; 18, pitch bearing; 19, rolling bearing; 20, universal joint (arranged on each of two ends of each lazy arm); 21, riser; 22, positioning and isolating structure; 23, water delivery rotary joint inner ring (static ring); 24, water delivery rotary joint outer ring (rotating ring); 25, water delivery rotary joint seal ring; 26, water cavity; 27, water delivery bearing outer ring (connected with the outer ring of the rotary joint); 28, water delivery bearing inner ring (connected with the inner ring of the rotary joint); 29, outer water delivery pipeline (led to FPSO); 30, inner water delivery pipeline (led to the manifold terminal); 31, oil delivery rotary joint inner ring (static ring); 32, oil delivery rotary joint outer ring (rotating ring); 33, oil delivery rotary joint seal ring; 34, oil cavity; 35, oil delivery bearing outer ring (connected with outer ring of the rotary joint); 36, oil delivery bearing inner ring (connected with the inner ring of the rotary joint); 37, outer oil delivery pipeline (led to FPSO); 38, inner oil delivery pipeline (led to the manifold terminal); 39, electric transmission rotary joint inner ring (static ring); 40, electric transmission rotary Joint outer ring (rotating ring); 41, electric transmission rotary joint seal ring; 42, electric brush; 43, electric transmission bearing outer ring (connected with the outer ring of the rotary joint); 44, electric transmission bearing inner ring (connected with the inner ring of the rotary joint); 45, outer electric transmission line (led to FPSO); 46, inner electric transmission line (led to the manifold terminal); 47, rotary joint driving arm; 48, driving arm supporting rack; 49, rotating table bearing inner ring (static ring fixed rigidly to the upright column; 50, rotating table bearing outer ring (rotating ring fixedly rigidly to the rotating table).

DETAILED DESCRIPTION OF THE PREFERRED EMBODIMENTS

In order to understand the technical scheme provided by the present disclosure more clearly, detailed description will be made below in combination with drawings of description by way of examples.

It is to be noted that more specific details are described in the description below for the convenience of understanding the present disclosure fully. However, the present disclosure may further be implemented by other modes different from those described, such that the protection scope of the present disclosure is not limited to the specific embodiments of the description.

Prior to describing the optional implementation modes provided by the present disclosure in combination with drawings, the technical concept of the present disclosure is introduced first.

The conventional wellhead platform to implement oil extraction operation subject to structure cannot be equipped with the bearing of the single-point mooring system, and it is necessary to improve the structure of the wellhead platform. Similarly, the existing mooring jacket cannot be used as a wellhead as the Christmas tree cannot be arranged. To accomplish the oil extraction operation, both mooring and wellhead operations are indispensable. With respect to dense oilfields with large outputs, it is feasible to configure the wellhead platform and the single-point mooring jacket simultaneously. The whole set of system is long in service life and the cost can be shared to a plurality of oilfields equally. The development cost of unit output can be very low, so that a very good economical benefit is gained. With respect to the marginal fields, the cost of unit output in the development mode is relatively high, so that the economical requirements cannot be met.

Therefore, the technical purpose to be realized by the present disclosure is as follows: with respect to a single isolated shallow marginal field, a set of system with all functions of well repair, production, power, oil storage, external transportation and living simultaneously is used, and meanwhile, facilities are as few as possible, and the input cost is as low as possible. Furthermore, well repair can be carried out at the same time in a normal working state without halting production. The system further can support a large enough oil storage space. The system is further high in ability to resist a severe marine environment and can resist a sea condition once every 50 years, and the oilfield is not halted in a sea condition once a year. In an extremely severe sea condition once every 100 years, the system can be disengaged quickly.

The core to realize the technical purpose lies in that a hollow upright column type platform structure is adopted, and the mooring rotating table which does not conflict with oil extraction operations on the top of the upright column and inside the upright column is arranged outside the upright column body.

Figure 2:
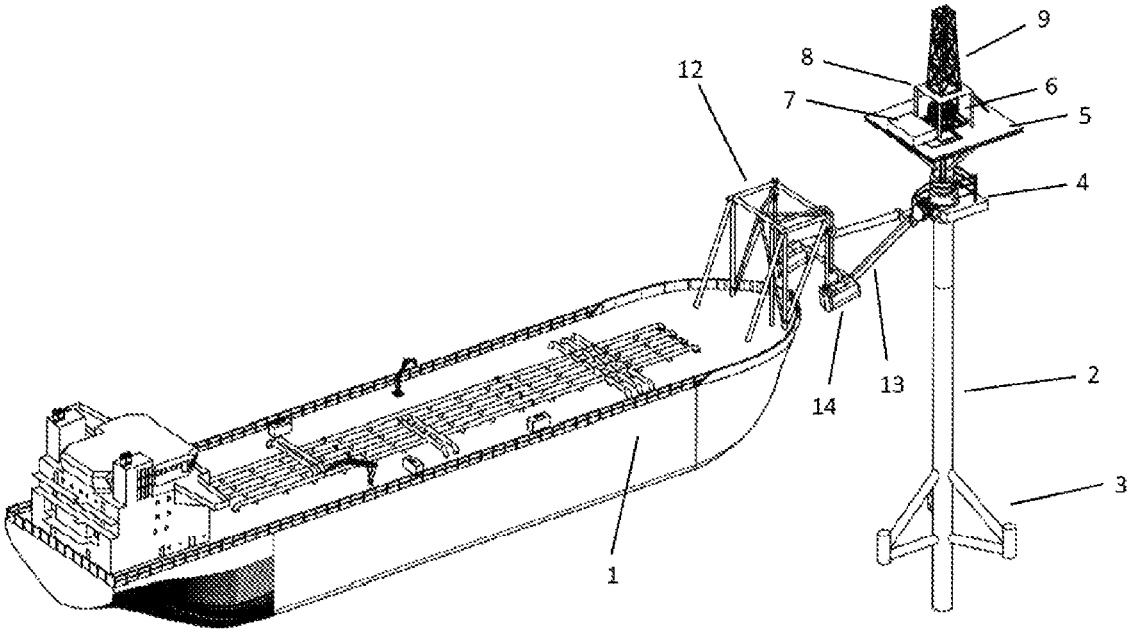
FIG. 2 illustrates an integral structural schematic diagram of an oilfield production operation system in an embodiment of the present disclosure, and portions herein are labeled.

In combination with FIG. 1 and FIG. 2, the oilfield production operation system based on the single-upright-column mooring type wellhead production operation platform is depicted. The system mainly includes the FPSO 1, the single-upright-column mooring type wellhead production operation platform and the waterborne soft rigid arm single-point mooring system. The implementation mode of the FPSO can be a production oil-storing tanker which can be obtained by modifying an old tanker. A tanker which is proper in size is selected according to an actual demand of the oilfield by adding necessary production facilities, generator sets, a mooring supporting rack and an external transportation module.

Figure 3:
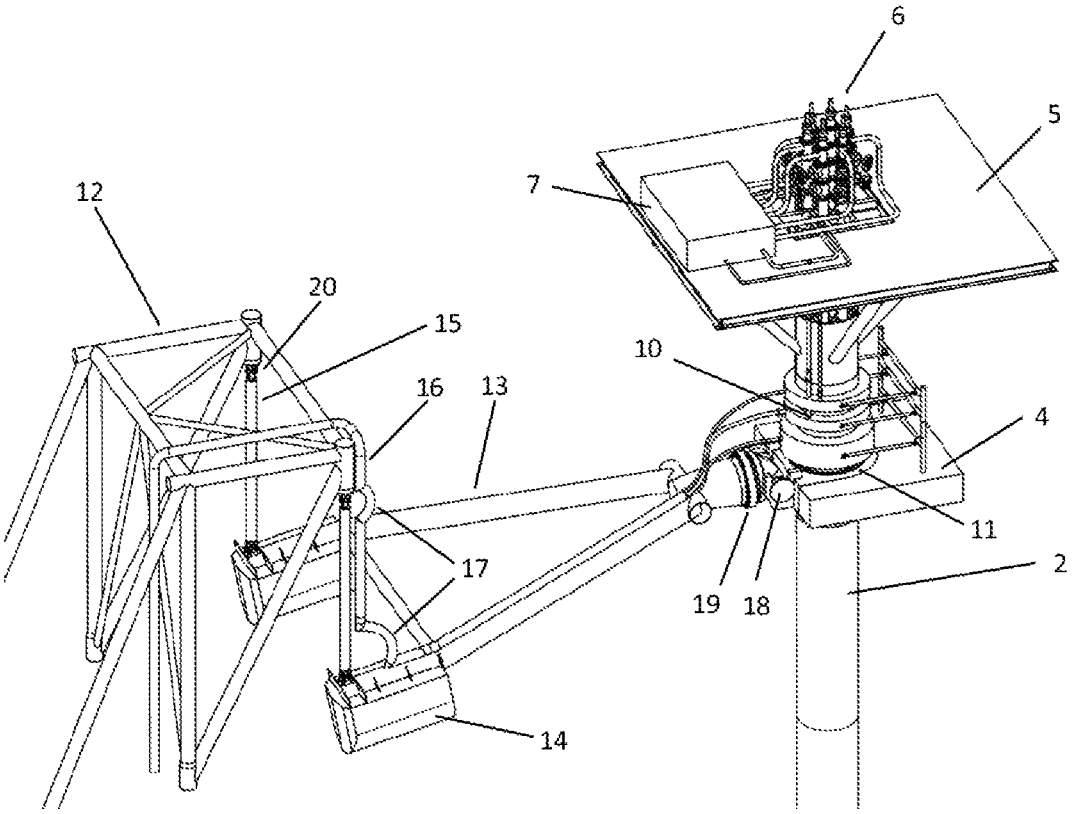
FIG. 3 illustrates a local structural schematic diagram of an oilfield production operation system in an embodiment of the present disclosure.

Referring to FIG. 3, the single-upright-column mooring type wellhead production operation platform mainly includes the upright column body 2, the positioning and mounting assembly 3, the rotating table 4, the wellhead deck 5, the Christmas tree 6, the manifold terminal 7, the well repairing deck 8, the hydraulic workover rig 9, the rotary conveying assembly 10 and the bearing 11 of the rotating table.

The diameter of the upright column body ranges from about 2 m to 6 m, and the upright column body can be driven into the seabed by a pile hammer and has a certain depth. The upright column body is hollow inside, so that the inner well slots can be formed in an array to arrange drilling vertical tubes or production vertical tubes. The bottom of the upright column is provided with three conduits which are distributed at 120 degrees, and the outer end of each of the conduits is driven and fixed to the seabed through the pile foundation.

The wellhead deck is arranged on the top of the upright column body, the top of each vertical tube is provided with the Christmas tree at the wellhead deck, and the Christmas trees are gathered to the manifold terminal on the wellhead deck. The well repairing deck is arranged above the wellhead deck, and the hydraulic workover rig is arranged. The rotating table is arranged below the wellhead deck, is connected with the upright column body through the bearing of the rotating table and can rotate in a horizontal plane around the upright column body. The rotary conveying assembly joints, for example, the conveying rotary joints which deliver oil, electricity and water respectively, are arranged above the rotating table. A manifold and a static portion of the rotary joint are connected via an oil tube, a water tube and a cable.

The soft rigid arm mooring system includes the mooring supporting rack 12, the horizontal balance weight rigid arm 13, the balance weight cabin 14, the mooring lazy arm 15, the rigid conveying pipeline 16, the flexible crossover pipeline 17 (can be used for conveying fluids and energy sources), the pitch bearing 18, the rolling bearing 19 and the universal joint 20.

Specifically, the soft rigid arm single-point mooring system is composed of an on-board supporting rack, two lazy arms and a horizontal balance weight rigid arm. One end of the balance weight rigid arm is connected with the rotating table of the single upright column platform, and a disengageable universal joint is arranged between the balance weight rigid arm and the rotating table, so that the balance weight rigid arm can rotate randomly (rotate around a horizontal axis, a vertical axis and a central axis) relative to the rotating table, and can be disengaged and connected back quickly. The other end of the balance weight rigid arm is provided with two balance weight cabins internally provided with balance weights. The upper sides of the balance weight cabins are connected with the lazy arms through the universal joints. The upper sides of the lazy arms are connected with the onboard supporting rack through the universal joints.

Figure 4:
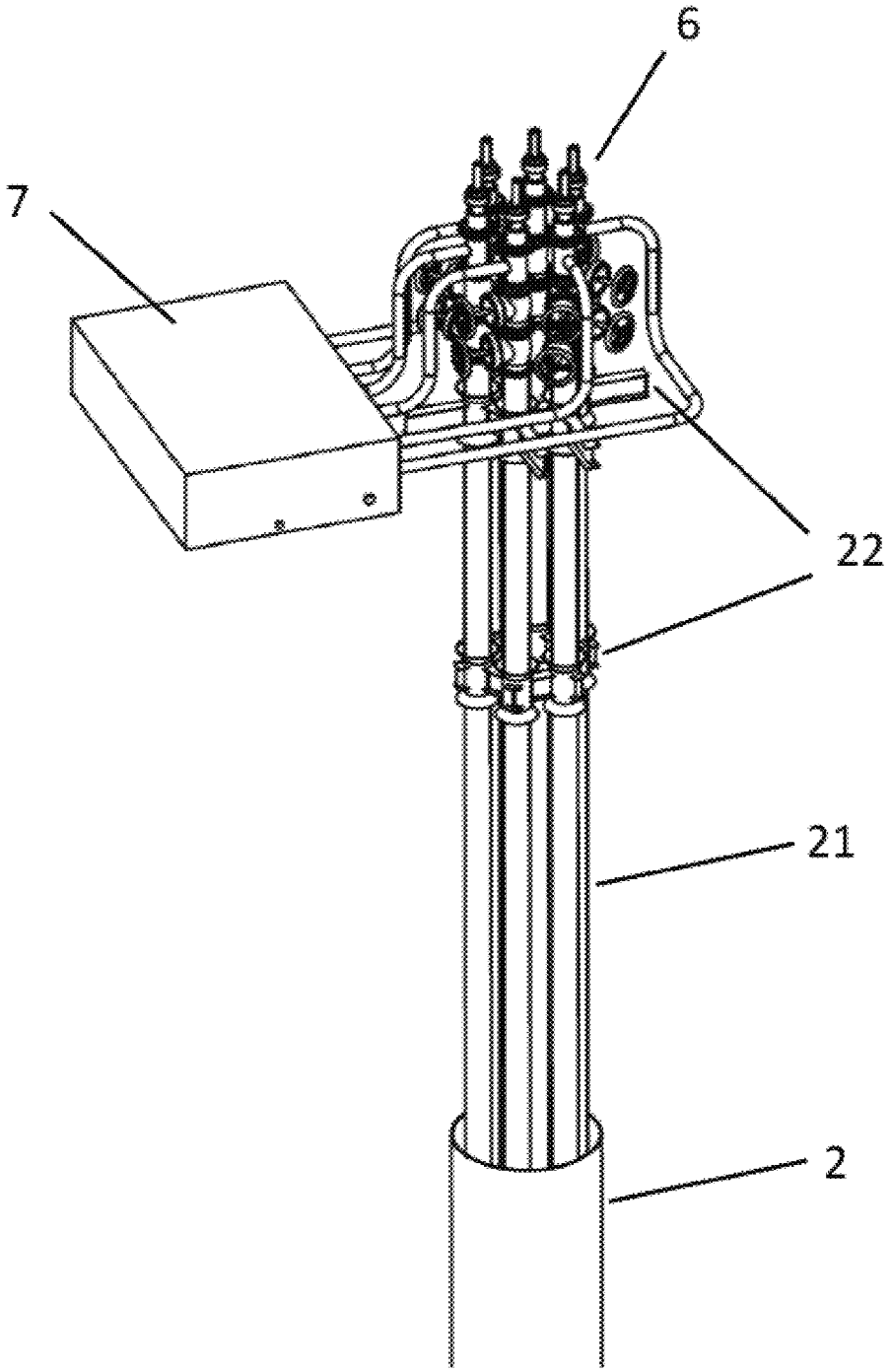
FIG. 4 illustrates a local structural schematic diagram of an upper half portion of a single-upright-column mooring type wellhead platform in an embodiment of the present disclosure, in which a rotating table is canceled.
Figure 5:
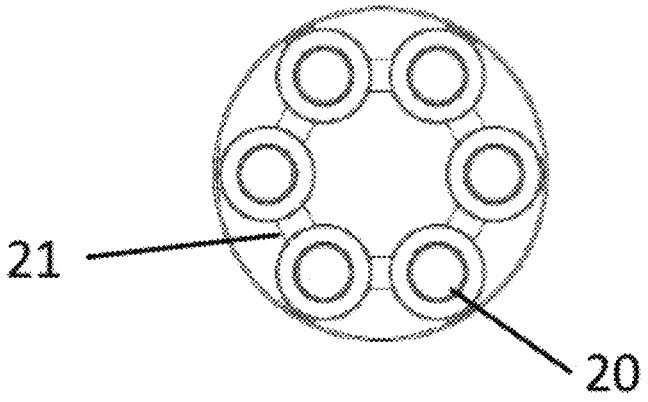
FIG. 5 illustrates a cross section view of an upright column body in a single-upright-column mooring type wellhead platform in an embodiment of the present disclosure.

As shown in FIG. 4, the riser 21 is located in the hollow structure of the upright column body 2 to form the inner well slot. Quantity and arrangement of the risers 21 can be determined according to pipe diameters and oilfield demands. The vertical tubes can stretch into the risers. The vertical tubes include production vertical tubes and water injection vertical tubes. The production vertical tubes pump a crude oil mixture from the seabed to the Christmas trees 6 on the wellhead deck 5, and the water injection vertical tubes pump water from the Christmas trees 6 above into the oilfield in the seabed. The manifold terminal 7 on the wellhead deck 5 is used to gather lines of all the Christmas trees 6, including oil and water pipelines as well as cables led to the Christmas trees 6. It is finally needed to communicate the oil, water and electricity to the FPSO.

Figure 8:
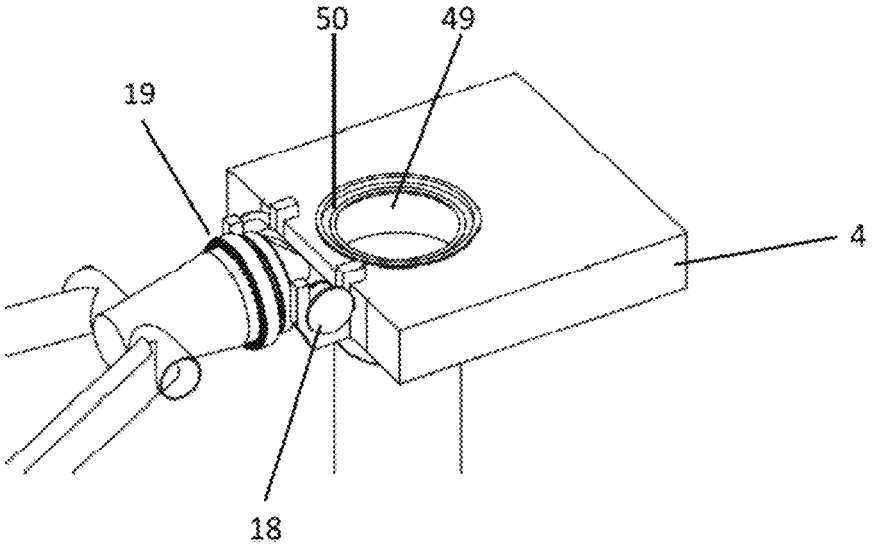
FIG. 8 illustrates a schematic diagram of a rotating platform and a related structure in a single-upright-column mooring type wellhead platform in an embodiment of the present disclosure.

Interaction between the single-upright-column mooring type wellhead production operation platform and the FPSO is divided into two portions:

First, the single-upright-column mooring type wellhead production operation platform provides the FPSO with mooring positioning. As a mooring anchor point of the FPSO, a mooring force is transferred by soft rigid arm mooring, so that the FPSO can rotate around the upright column body under the action of a wind flow. As shown in FIG. 8, the rotating table bearing inner ring 49 is fixed to the upright column body 2, the rotating table bearing outer ring 50 is fixed to the rotating table 4, and the rotating table 4 is connected with the horizontal balance weight rigid arm 13 of the soft rigid arm, so that the FPSO and the soft rigid arm can drive the rotating table 4 to rotate around the upright column body 2. In addition, the pitch bearing 18 and the rolling bearing 19 can relieve pitching and rolling rotation of the horizontal balance weight rigid arm 13, so that the horizontal balance weight rigid arm 13 driven by the FPSO can pitch and roll freely, and the FPSO is not restrained, and thus a larger load can be born. Therefore, large-tonnage storage can be allowed. On the other hand, the mooring supporting rack is fixed to the FPSO rigidly, the mooring lazy arms 15 are suspended on the mooring supporting rack 12 and are connected with laid-down balance weight cabins 14, and when the FPSO surges, the mooring lazy arms 15 will incline, so that the balance weight cabins 14 are improved to work. A tensile force of the balance weight cabin 14 to the mooring lazy arm 15 will generate a horizontal component, and the component of the force opposite to the moving direction of a ship body is taken as a restoring force to pull the PFSO back to a balanced position. In addition, the universal joint 20 can be provided with the quick disengaging apparatus. Upon arrival of extremely severe weather exceeding design arrives (for example, a sea condition once 100 years), the system can be disengaged quickly. The quick disengaging apparatus is a common safety measure in the field, and can be disengaged automatically by means of load change. As an alternative implementation mode, the quick disengaging apparatus can be further arranged at a mooring connection.

Second, the FPSO conveys oil, water and electricity when rotating relative to the upright column body. This portion is mainly accomplished dependent on the rotary conveying assembly 10. Details of the specific structure are seen below.

In addition, a contact surface of the inner ring that conveys fluids such as water and oil and the outer ring is internally provided with an annular cavity. The cavity is provided with a dynamic seal ring at an interface of the two rings, so that it is ensured that the fluid in the cavity is not leaked during rotation. The cavity is provided with a channel outlet on each of the inner and outer ring sides. The contact surface of the inner ring and the upright column body is further provided with a groove to form a channel from bottom to top. The channel allows the liquid below the rotary joint or the pipeline or the cable of an outlet of a static portion of an electric rotary joint to penetrate and to be led to the manifold on the wellhead deck.

When the oilfield works normally, the FPSO positioned by the soft rigid arm single point only can rotate around the platform and perform limited surging, pitching and rolling motions. The FPSO provides power and personnel live on the PFSO. Electricity and water arrive the platform manifold via the rotary joint and then enter an oil well via the Christmas trees and the vertical tubes. Meanwhile, the crude oil mixture collected enters the platform manifold via the Christmas trees and the vertical tubes and then arrive the FPSO to produce via the rotary joint, and produced crude oil is stored in the PFSO, waiting for the shuttle tanker to extract oil periodically. When it is necessary to repair the well, it is unnecessary to halt production and it is only necessary to pause the Christmas tree needed by well repair, take out the production or water injection vertical tubes and replace the production or water injection vertical tubes with the drilling vertical tubes. The well is repaired via the hydraulic workover rig 9, and after well repair, and the production or water injection vertical tubes are replaced by the production vertical tubes to produce.

In addition, as an implementation mode implemented based on the abovementioned scheme:

The decks above the single-upright-column mooring type wellhead production operation platform are not limited to wellhead decks and well repairing decks. Decks needed by other production operations can be additionally arranged, for example, a manifold deck, a water injection deck, an embarkation deck and the like.

The structure of the positioning and mounting assembly at the bottom of the upright column body is not limited to a form of three inclined struts in angles of 120 degrees. Other forms, for example, frame supporting, single-side inclined struts, diagonal lock fixing and the like can be selected according to actual conditions and structural design in the seabed. The way that the supporting legs are fixed to the seabed is not limited to connection by pile driving, and can further use a suction anchor. The supporting legs can be further directly tamped into the seabed by using the upright column body as a single pile foundation.

The quantity of the rotary conveying joints is not limited to three, and channels can be increased according to actual needs of the oilfield. The types are not limited to oil, water and electricity rotary joints. Air rotary joints, multifunctional auxiliary rotary joints and the like can be further additionally arranged.

The well repairing mode is not limited to the hydraulic workover rig, and a derrick can be further mounted above the well repairing deck by using a conventional workover rig.

The quick disengaging apparatus of the soft rigid arm system is not limited to a connection arranged between the horizontal balance weight rigid arm and the rotating table, and can be further arranged at a connection between the lazy arm and the horizontal balance weight rigid arm.

Therefore, the technical purpose realized by the present disclosure further includes: a hollow upright column type platform structure is adopted, and the mooring rotating table which does not conflict with oil extraction operations on the top of the upright column and inside the upright column is arranged outside the upright column body.

In combination with FIG. 1 and FIG. 2, the oilfield production operation system based on the single-upright-column mooring type wellhead production operation platform is depicted. The system mainly includes the FPSO 1, the single-upright-column mooring type wellhead production operation platform and the waterborne soft rigid arm single-point mooring system. The implementation mode of the FPSO can be a production oil-storing tanker which can be obtained by modifying an old tanker. A tanker which is proper in size is selected according to an actual demand of the oilfield by adding necessary production facilities, generator sets, a mooring supporting rack and an external transportation module.

Referring to FIG. 3, the single-upright-column mooring type wellhead production operation platform mainly includes the upright column body 2, the positioning and mounting assembly 3, the rotating table 4, the wellhead deck 5, the Christmas tree 6, the manifold terminal 7, the well repairing deck 8, the hydraulic workover rig 9, the rotary mooring conveying system 10 and the bearing 11 of the rotating table.

Interaction between the single-upright-column mooring type wellhead production operation platform and the FPSO is divided into two portions:

First, the single-upright-column mooring type wellhead production operation platform provides the FPSO with mooring positioning. As a mooring anchor point of the FPSO, a mooring force is transferred by soft rigid arm mooring, so that the FPSO can rotate around the upright column body under the action of a wind flow. As shown in FIG. 8, the rotating table bearing inner ring 49 is fixed to the upright column body 2, the rotating table bearing outer ring 50 is fixed to the rotating table 4, and the rotating table 4 is connected with the horizontal balance weight rigid arm 13 of the soft rigid arm, so that the FPSO and the soft rigid arm can drive the rotating table 4 to rotate around the upright column body 2. In addition, the pitch bearing 18 and the rolling bearing 19 can relieve pitching and rolling rotation of the horizontal balance weight rigid arm 13, so that the horizontal balance weight rigid arm 13 driven by the FPSO can pitch and roll freely, and the FPSO is not restrained, and thus a larger load can be born. Therefore, large-tonnage storage can be allowed. On the other hand, the mooring supporting rack is fixed to the FPSO rigidly, the lazy arms 15 are suspended on the mooring supporting rack 12 and are connected with laid-down balance weight cabins 14, and when the FPSO surges, the lazy arms 15 will incline, so that the balance weight cabins 14 are improved to work. A tensile force of the balance weight cabin 14 to the lazy arm 15 will generate a horizontal component, and the component of the force opposite to the moving direction of a ship body is taken as a restoring force to pull the PFSO back to a balanced position. In addition, the universal joint 20 can be provided with the quick disengaging apparatus. Upon arrival of extremely severe weather exceeding design arrives (for example, a sea condition once 100 years), the system can be disengaged quickly. The quick disengaging apparatus is a common safety measure in the field, and can be disengaged automatically by means of load change. As an alternative implementation mode, the quick disengaging apparatus can be further arranged at a mooring connection.

Figure 6:
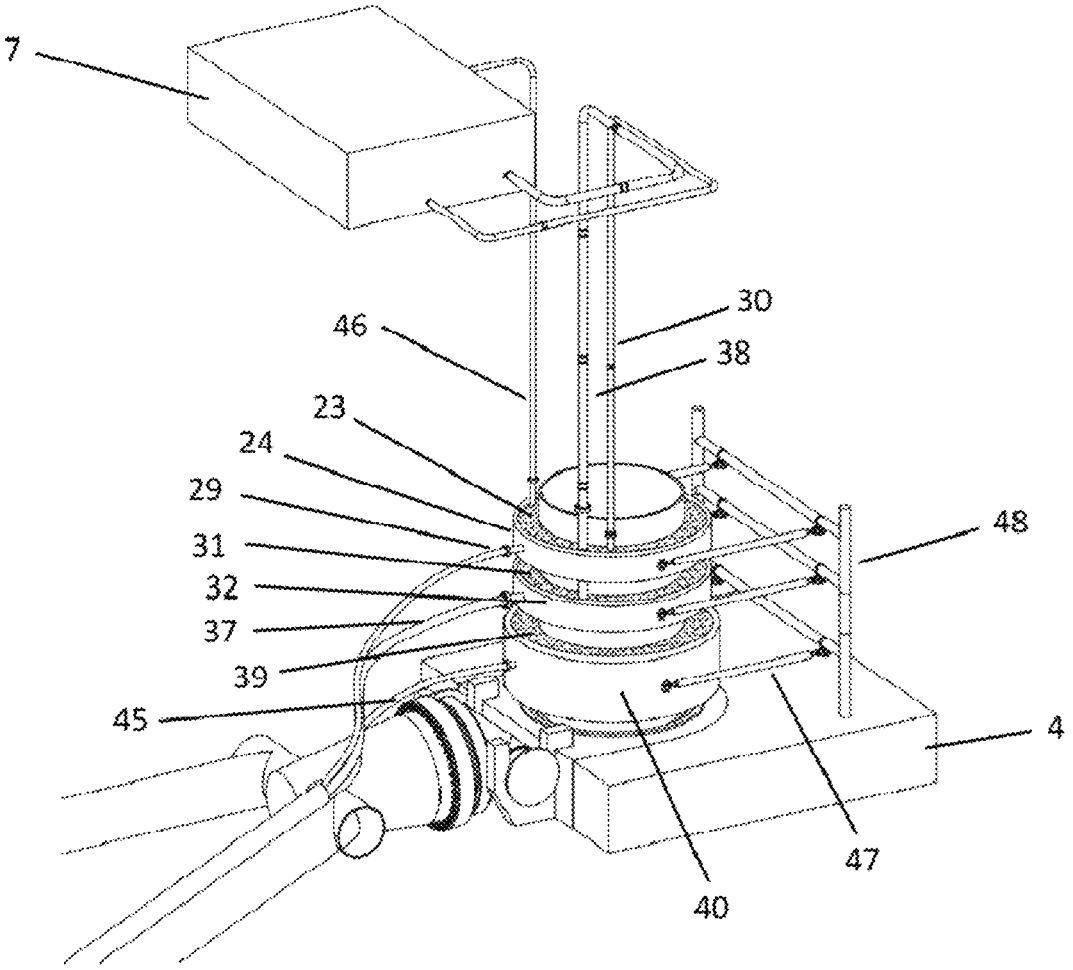
FIG. 6 illustrates a local structural schematic diagram of an upper half portion of a single-upright-column mooring type wellhead platform, in which a part of upright column body is canceled.
Figure 7:
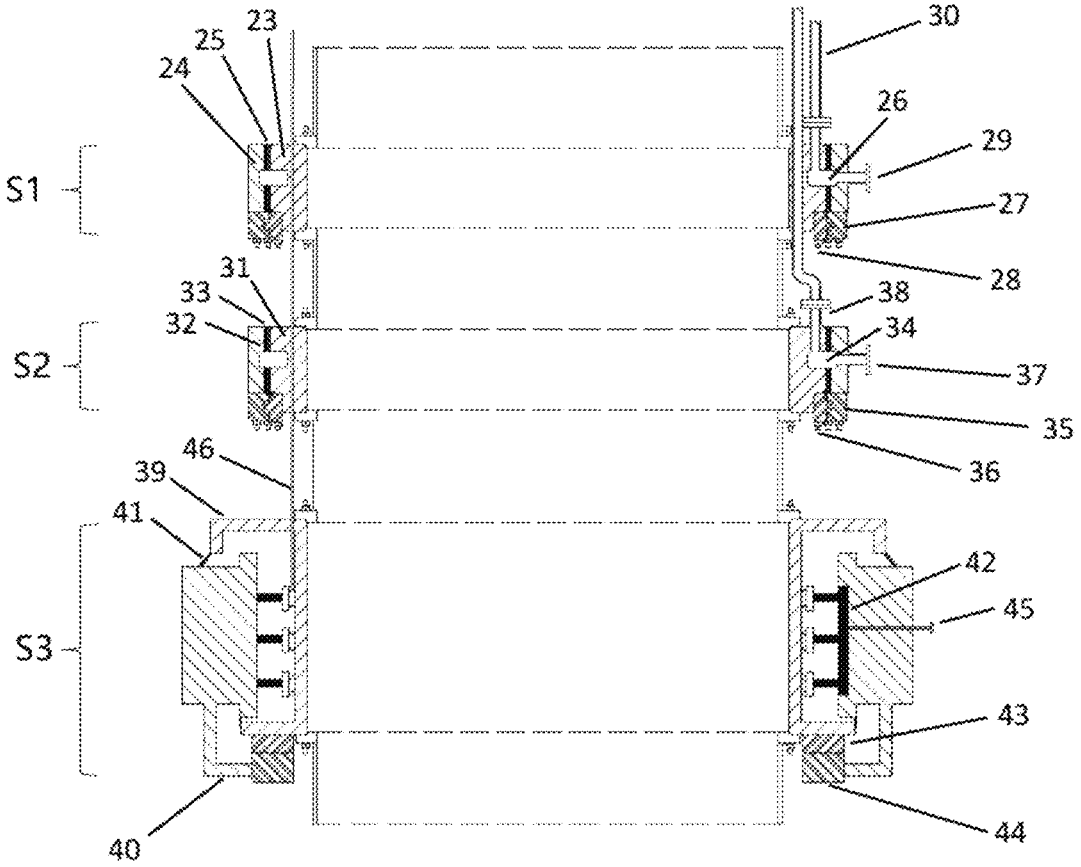
FIG. 7 illustrates a local sectional structural schematic diagram of a portion of a rotary conveying joint mounted in a single-upright-column mooring type wellhead platform in an embodiment of the present disclosure.

Second, the FPSO conveys oil, water and electricity when rotating relative to the upright column body. This portion is mainly accomplished dependent on the rotary mooring conveying system 10. In order to achieve noninterference between rotary conveyance and oil extraction operation, the rotary conveying joints in the rotary mooring conveying system are arranged in hollow forms and the position of the rotary mooring conveying system is arranged below the wellhead deck. In the implementation modes as shown in FIG. 6 and FIG. 7, the rotary mooring conveying system successively includes the water conveying joint S1, the oil transportation joint S2 and the electricity transmission joint S3 from top to bottom. The inner and outer rings (23, 24, 31, 32, 39 and 40) of the rotary joint are respectively connected with the bearing inner and outer rings (27, 28, 35, 36, 43 and 44). When the rotating table 4 rotates, with assistance of the bearings (27, 28. 35, 36, 43 and 44), the driving arm supporting rack 48 and the rotary join driving arm 47 connected to the rotating table drive the rotary joint outer rings 24 (water), 32 (oil) and 40 (electricity) to rotate together and the rotary joint inner rings 23 (water), 31 (oil) and 39 (electricity) are rigidly connected with the upright column body and are kept stationary. Annular cavities 26 and 34 are respectively formed in the middle portions of the rotary joint outer rings 24 (water) and 32 (oil) and the rotary joint inner rings 23 (water) and 31 (oil), and one ends of the annular cavities 26 and 34 are connected to pipelines 29 and 37 led to the PFSO and the other ends thereof are connected with manifolds 30 and 38 lead to the platform manifold. Dynamic seal rings 25 and 33 are respectively arranged on the contact surfaces of the inner and outer rings at the edges of the cavities 26 and 34. The seal rings are prepared from rubber materials featuring in corrosion resistance, high-temperature resistance, wear resistance and high elasticity, for example, silicone rubber, fluororubber, ethylene propylene rubber and acrylic rubber. When the pressures in the cavities 26 and 34 are larger, rotary friction of the contact surfaces of the inner and outer rings of the rotary joints and sealing can be guaranteed. The inner ring 39 and the outer ring 40 of the electric transmission rotary Joint are respectively connected with electric brushes 42. The electric brushes are annular. When the rotary joint rotates, two ends of the electric brushes are contacted all the time, so that it is ensured that a circuit is communicated. The contact surface between the inner ring 39 and the outer ring 40 of the electric transmission rotary joint is provided with the seal ring 41, too.

As an expanded optional implementation mode, a signal transmission joint similar to the electric transmission joint is structure can be further adopted. The lines and the electric brushes are used for transmitting electric signals.

In addition, a contact surface of the inner ring that conveys fluids such as water and oil and the outer ring is internally provided with an annular cavity. The cavity is provided with a dynamic seal ring at an interface of the two rings, so that it is ensured that the fluid in the cavity is not leaked during rotation. The cavity is provided with a channel outlet on each of the inner and outer ring sides. The contact surface of the inner ring and the upright column body is further provided with a groove to form a channel from bottom to top. The channel allows the liquid below the rotary joint or the pipeline or the cable of an outlet of a static portion of an electric rotary joint to penetrate and to be led to the manifold on the wellhead deck.

When the oilfield works normally, the FPSO positioned by the soft rigid arm single point only can rotate around the platform and perform limited surging, pitching and rolling motions. The FPSO provides power and personnel live on the PFSO. Electricity and water arrive the platform manifold via the rotary joint and then enter an oil well via the Christmas trees and the vertical tubes. Meanwhile, the crude oil mixture collected enters the platform manifold via the Christmas trees and the vertical tubes and then arrive the FPSO to produce via the rotary joint, and produced crude oil is stored in the PFSO, waiting for the shuttle tanker to extract oil periodically. When it is necessary to repair the well, it is unnecessary to halt production and it is only necessary to pause the Christmas tree needed by well repair, take out the production or water injection vertical tubes and replace the production or water injection vertical tubes with the drilling vertical tubes. The well is repaired via the hydraulic workover rig 9, and after well repair, and the production or water injection vertical tubes are replaced by the production vertical tubes to produce.

In addition, in a matched manner, the diameter of the upright column body ranges from about 2 m to 6 m, and the upright column body can be driven into the seabed by a pile hammer and has a certain depth. The upright column body is hollow inside, so that the inner well slots can be formed in an array to arrange drilling vertical tubes or production vertical tubes. The bottom of the upright column is provided with three conduits which are distributed at 120 degrees, and the outer end of each of the conduits is driven and fixed to the seabed through the pile foundation.

The wellhead deck is arranged on the top of the upright column body, the top of each vertical tube is provided with the Christmas tree at the wellhead deck, and the Christmas trees are gathered to the manifold terminal on the wellhead deck. The well repairing deck is arranged above the wellhead deck, and the hydraulic workover rig is arranged. The rotating table is arranged below the wellhead deck, is connected with the upright column body through the bearing of the rotating table and can rotate in a horizontal plane around the upright column body. The rotary mooring conveying system joints, for example, the conveying rotary joints which deliver oil, electricity and water respectively, are arranged above the rotating table. A manifold and a static portion of the rotary joint are connected via an oil tube, a water tube and a cable.

The soft rigid arm mooring system includes the mooring supporting rack 12, the horizontal balance weight rigid arm 13, the balance weight cabin 14, the mooring lazy arm 15, the rigid conveying pipeline 16, the flexible crossover pipeline 17 (can be used for conveying fluids and energy sources), the pitch bearing 18, the rolling bearing 19 and the universal joint 20.

Specifically, the soft rigid arm single-point mooring system is composed of an on-board supporting rack, two lazy arms and a horizontal balance weight rigid arm. One end of the balance weight rigid arm is connected with the rotating table of the single upright column platform, and a disengageable universal joint is arranged between the balance weight rigid arm and the rotating table, so that the balance weight rigid arm can rotate randomly (rotate around a horizontal axis, a vertical axis and a central axis) relative to the rotating table, and can be disengaged and connected back quickly. The other end of the balance weight rigid arm is provided with two balance weight cabins internally provided with balance weights. The upper sides of the balance weight cabins are connected with the lazy arms through the universal joints. The upper sides of the lazy arms are connected with the onboard supporting rack through the universal joints.

As shown in FIG. 4, the riser 21 is located in the hollow structure of the upright column body 2 to form the inner well slot. Quantity and arrangement of the risers 21 can be determined according to pipe diameters and oilfield demands. The vertical tubes can stretch into the risers. The vertical tubes include production vertical tubes and water injection vertical tubes. The production vertical tubes pump a crude oil mixture from the seabed to the Christmas trees 6 on the wellhead deck 5, and the water injection vertical tubes pump water from the Christmas trees 6 above into the oilfield in the seabed. The manifold terminal 7 on the wellhead deck 5 is used to gather lines of all the Christmas trees 6, including oil and water pipelines as well as cables led to the Christmas trees 6. It is finally needed to communicate the oil, water and electricity to the FPSO.

In addition, as an implementation mode implemented based on the abovementioned scheme:

The decks above the single-upright-column mooring type wellhead production operation platform are not limited to wellhead decks and well repairing decks. Decks needed by other production operations can be additionally arranged, for example, a manifold deck, a water injection deck, an embarkation deck and the like.

The structure of the positioning and mounting assembly at the bottom of the upright column body is not limited to a form of three inclined struts in angles of 120 degrees. Other forms, for example, frame supporting, single-side inclined struts, diagonal lock fixing and the like can be selected according to actual conditions and structural design in the seabed. The way that the supporting legs are fixed to the seabed is not limited to connection by pile driving, and can further use a suction anchor. The supporting legs can be further directly tamped into the seabed by using the upright column body as a single pile foundation.

The quantity of the rotary conveying joints is not limited to three, and channels can be increased according to actual needs of the oilfield. The types are not limited to oil, water and electricity rotary joints. Air rotary joints, multifunctional auxiliary rotary joints and the like can be further additionally arranged.

The well repairing mode is not limited to the hydraulic workover rig, and a derrick can be further mounted above the well repairing deck by using a conventional workover rig.

The quick disengaging apparatus of the soft rigid arm system is not limited to a connection arranged between the horizontal balance weight rigid arm and the rotating table, and can be further arranged at a connection between the lazy arm and the horizontal balance weight rigid arm.

The technical purpose to be realized by the present disclosure further includes: with respect to a single isolated shallow marginal field, a set of system with all functions of well repair, production, power, oil storage, external transportation and living simultaneously is used, and meanwhile, facilities are as few as possible, and the input cost is as low as possible. Furthermore, well repair can be carried out at the same time in a normal working state without halting production. It is further unnecessary to consider the severe marine environmental influence.

The core to realize the technical purpose lies in that the hollow upright column type platform structure is adopted, at least one, preferably more inner well slots are formed in the hollow upright column body, and a plurality of drilled wells work independently without interfering with each other by means of positioning and isolating measures. The conveying pipeline is in butt joint to the adjacent developed oilfield via the seabed pipeline and the seabed cable without mooring the FPSO so as to prevent the FPSO from seawave and sea wind impact loads, so that it can resist an extremely severe sea condition.

Figure 9:
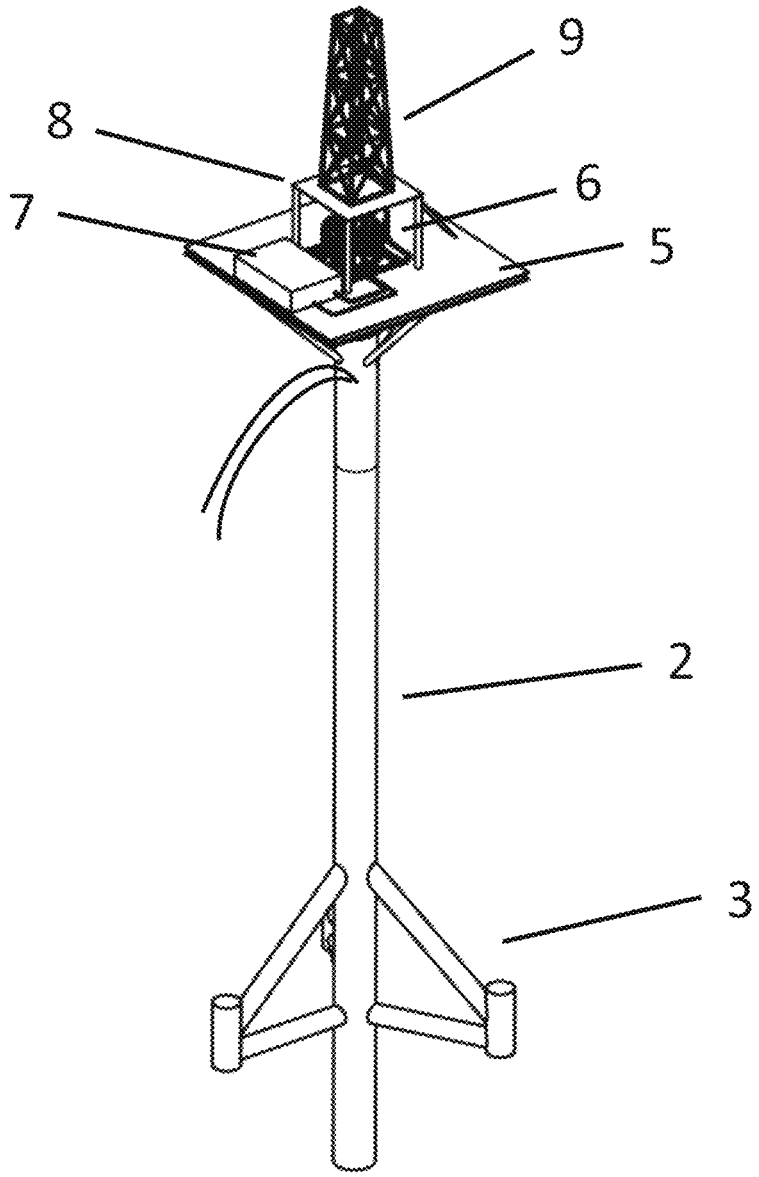
FIG. 9 illustrates an integral structural schematic diagram of a single-upright-column mooring type wellhead platform in an embodiment of the present disclosure.

In combination with FIG. 9, FIG. 2 and FIG. 3, the structural composition of the single-upright-column type wellhead production operation platform is depicted.

The single-upright-column mooring type wellhead production operation platform mainly includes the upright column body 2, the positioning and mounting assembly 3, the wellhead deck 5, the Christmas tree 6, the manifold terminal 7, the well repairing deck 8 and the hydraulic workover rig 9.

The diameter of the upright column body ranges from about 2 m to 6 m, and the upright column body can be driven into the seabed by a pile hammer and has a certain depth. The upright column body is hollow inside, so that the inner well slots can be formed in an array to arrange drilling vertical tubes or production vertical tubes. The bottom of the upright column is provided with three conduits which are distributed at 120 degrees, and the outer end of each of the conduits is driven and fixed to the seabed through the pile foundation.

The wellhead deck is arranged on the top of the upright column body, the top of each vertical tube is provided with the Christmas tree at the wellhead deck, and the Christmas trees are gathered to the manifold terminal on the wellhead deck. The well repairing deck is arranged above the wellhead deck, and the hydraulic workover rig is arranged. The manifold terminal connects the seabed pipeline with the cable to convey energy sources and exploited crude oil between the platform and the adjacent developed oilfield.

As shown in FIG. 3, the riser 21 is located in the hollow structure of the upright column body 2 to form the inner well slot. Quantity and arrangement of the risers 21 can be determined according to pipe diameters and oilfield demands. The vertical tubes can stretch into the risers. The vertical tubes include production vertical tubes and water injection vertical tubes. The production vertical tubes pump a crude oil mixture from the seabed to the Christmas trees 6 on the wellhead deck 5, and the water injection vertical tubes pump water from the Christmas trees 6 above into the oilfield in the seabed. The manifold terminal 7 on the wellhead deck 5 is used to gather lines of all the Christmas trees 6, including oil and water pipelines led to the Christmas trees 6 as well as cables. It is finally needed to connect the oil, water and electricity to the adjacent developed oilfield.

When it is necessary to repair the well, it is unnecessary to halt production and it is only necessary to pause the Christmas tree needed by well repair, take out the production or water injection vertical tubes and replace the production or water injection vertical tubes with the drilling vertical tubes. The well is repaired via the hydraulic workover rig 9, and after well repair, and the production or water injection vertical tubes are replaced by the production vertical tubes to produce.

In addition, as an implementation mode implemented based on the abovementioned scheme:

The decks above the single-upright-column mooring type wellhead production operation platform are not limited to wellhead decks and well repairing decks. Decks needed by other production operations can be additionally arranged, for example, a manifold deck, a water injection deck, an embarkation deck and the like.

The structure of the positioning and mounting assembly at the bottom of the upright column body is not limited to a form of three inclined struts in angles of 120 degrees. Other forms, for example, frame supporting, single-side inclined struts, diagonal lock fixing and the like can be selected according to actual conditions and structural design in the seabed. The way that the supporting legs are fixed to the seabed is not limited to connection by pile driving, and can further use a suction anchor. The supporting legs can be further directly tamped into the seabed by using the upright column body as a single pile foundation.

The well repairing mode is not limited to the hydraulic workover rig, and a derrick can be further mounted above the well repairing deck by using a conventional workover rig.

In addition, although the scheme of the present disclosure is put forward for the marginal fields, the present disclosure is not limited to the application environment of the scheme. Under the condition of meeting economy and safety and stability of equipment, the scheme of the present disclosure can be further implemented in non-marginal fields to form a "platform network" by way of multiple platforms.

The invention claimed is:

1. A single-upright-column mooring type wellhead production operation platform, the platform comprising:

an upright column body of a hollow structure;

a positioning and mounting assembly arranged at a bottom of the upright column body, the positioning and mounting assembly comprises several pile foundations and a conduit that connects the pile foundations with the upright column body; or the positioning and mounting assembly comprises a pile foundation column body that extends downwards along a bottom of the upright column body;

a rotating table arranged outside the upright column body and rotatable around an axis of the upright column body, the rotating table comprising a mooring connection apparatus;

an oil extraction operation platform arranged on the top of the upright column body and located above the rotating table, the oil extraction operation platform being provided with an oil extraction operation assembly, the oil extraction operation platform comprises a wellhead deck, and the oil extraction operation assembly comprises at least one of an oil extraction tree, a manifold terminal and a production auxiliary system; and at least one inner well slot arranged in the upright column body, the inner well slot being capable of being connected to the oil extraction operation platform;

the platform further comprising a rotary conveying assembly connected with the rotating table; a driving arm supporting rack arranged on the rotating table, the driving arm supporting rack is connected with the rotary conveying assembly through a drive arm.

2. The single-upright-column mooring type wellhead production operation platform according to claim 1, wherein the rotating table comprises a rotating table main body and a rotating table bearing, an inner ring of the rotating table bearing being fixedly connected with the upright column body.

3. The single-upright-column mooring type wellhead production operation platform according to claim 1, the rotary conveying assembly comprising:

several rotary conveying joints, each of the rotary conveying joints comprising:

an inner conveying ring fixedly connected with the upright column body;

an outer conveying ring following the rotating table to rotate relative to the inner conveying ring, wherein a conveying structure capable of keeping conveying in a rotating process is arranged between the inner conveying ring and the outer conveying ring;

an inner conveying unit connected with the conveying structure and the oil extraction operation assembly; and an outer conveying unit connected with the conveying structure.

4. The single-upright-column mooring type wellhead production operation platform according to claim 1, wherein the inner well slot comprises a riser connected with the oil extraction operation platform or the oil extraction operation assembly; and the upright column body is internally provided with a positioning and isolating structure that supports the riser.

5. The single-upright-column mooring type wellhead production operation platform according to claim 1, wherein the mooring connection apparatus comprises a rotating joint and a disconnecting apparatus arranged on the rotating joint, the disconnecting apparatus being configured to remove a connection between the rotating joint and the rotating table or the disconnecting apparatus being configured to remove a connection between the disconnecting apparatus and the rotating joint.

6. An oilfield production operation system, the system comprising:

the single-upright-column mooring type wellhead production operation platform according to of claim 1;

a floating production oil storing and unloading apparatus, the floating production oil storing and unloading apparatus is FPSO; and a mooring apparatus that connects the floating production oil storing and unloading apparatus with the mooring connection apparatus, the mooring apparatus is a rotating joint and a disconnecting apparatus arranged on the rotating joint.

7. A single-upright-column type wellhead production operation platform, the platform comprising:

an upright column body of a hollow structure;

a positioning and mounting assembly arranged at a bottom of the upright column body, the positioning and mounting assembly comprises several pile foundations and a conduit that connects the pile foundations with the upright column body; or the positioning and mounting assembly comprises a pile foundation column body that extends downwards along a bottom of the upright column body;

an oil extraction operation platform arranged on the top of the upright column body, the oil extraction operation platform being provided with an oil extraction operation assembly, the oil extraction operation platform comprises a wellhead deck, and the oil extraction operation assembly comprises at least one of an oil extraction tree, a manifold terminal and a production auxiliary system; and at least one inner well slot arranged in the upright column body, the inner well slot being capable of being connected to the oil extraction operation platform;

the oil extraction operation platform further includes a well repair deck arranged above the wellhead deck and is used to bear a well repair device.

8. The single-upright-column type wellhead production operation platform according to claim 7, wherein the inner well slot comprises a riser connected with the oil extraction operation platform or the oil extraction operation assembly; and the upright column body is internally provided with a positioning and isolating structure that supports the riser.

9. The single-upright-column type wellhead production operation platform according to claim 8, wherein there are a plurality of risers; and the positioning and isolating structure comprises:

a plurality of positioning rings sleeved outside the risers, the positioning rings being connected successively via a connecting rib; and a radial support connected with the positioning rings and/or the connecting rib, the radial support leaning against or being connected with an inner wall of the hollow structure of the upright column body.

10. A rotary mooring conveying system, the system comprising several rotary conveying joints, each of the rotary conveying joints comprising:

an inner conveying ring;

an outer conveying ring capable of rotating relative to the inner conveying ring, wherein a conveying structure capable of keeping conveying in a rotating process is arranged between the inner conveying ring and the outer conveying ring; and an inner conveying unit, the inner conveying unit being connected with the inner conveying ring; and an outer conveying unit, the outer conveying unit being connected with the outer conveying ring, wherein the inner conveying rings of the rotary conveying joints are fixedly connected;

at least one rotary conveying joint is a fluid conveying joint;

the conveying structure is an annular fluid groove formed between the inner conveying ring and the outer conveying ring, the inner conveying unit comprises a fluid pipeline, and the fluid pipeline is communicated with the annular fluid groove.

11. The rotary mooring conveying system according to claim 10, wherein the several rotary conveying joints are successively arranged from top to bottom, and the inner conveying units connected with the inner conveying rings of the rotary conveying joints located below penetrate through inner channels formed in the inner conveying rings of the rotary conveying joints above.

12. The rotary mooring conveying system according to claim 10, wherein a fluid conveyed by the fluid conveying joint is selected from one or more of water, oil and gas.

13. The rotary mooring conveying system according to claim 10, wherein a dynamic seal ring is arranged between the inner conveying ring and the outer conveying ring to form a sealing structure that isolates the annular fluid groove and outside.

14. The rotary mooring conveying system according to claim 10, wherein at least one rotary conveying joint is an energy conveying joint, the conveying structure is an electric brush arranged between the inner conveying ring and the outer conveying ring, and the inner conveying unit comprises a power supply line electrically connected with the electric brush, or at least one rotary conveying joint is a data transmission joint, the conveying structure is an electric brush arranged between the inner conveying ring and the outer conveying ring, and the inner conveying unit comprises a data line electrically connected with the electric brush.

* * * * *